US007927674B2

(12) United States Patent
Spaar

(10) Patent No.: US 7,927,674 B2
(45) Date of Patent: Apr. 19, 2011

(54) FOLDABLE PARTY DECORATION

(75) Inventor: Keith Alan Spaar, River Vale, NJ (US)

(73) Assignee: Amscan, Inc., Elmsford, NY (US)

( * ) Notice: Subject to any disclaimer, the term of this patent is extended or adjusted under 35 U.S.C. 154(b) by 875 days.

(21) Appl. No.: 11/749,564

(22) Filed: May 16, 2007

(65) Prior Publication Data

US 2008/0286499 A1 Nov. 20, 2008

(51) Int. Cl.

| | |
|---|---|
| ***A47G 33/04*** | (2006.01) |
| ***G09F 11/00*** | (2006.01) |
| ***G09F 3/02*** | (2006.01) |
| ***G09F 7/22*** | (2006.01) |

(52) U.S. Cl. ..... 428/11; 428/7; 428/12; 40/1; 40/631; 40/632; 40/617

(58) Field of Classification Search ..... None
See application file for complete search history.

(56) References Cited

U.S. PATENT DOCUMENTS

| | | | | |
|---|---|---|---|---|
| 1,621,703 | A * | 3/1927 | Adams | 428/9 |
| 3,709,767 | A * | 1/1973 | Saiga | 428/9 |
| 6,042,903 | A * | 3/2000 | Yedlin et al. | 428/7 |

FOREIGN PATENT DOCUMENTS

JP 2002172012 * 6/2002

* cited by examiner

*Primary Examiner* — Gordon R Baldwin
(74) *Attorney, Agent, or Firm* — Leason Ellis LLP

(57) ABSTRACT

A decoration in a variety of shapes and including a substantially flat main body and a string. The main body has a plurality of extensions extending from a base portion. Each extension has an aperture therethrough at its free end. The string passes through each aperture in a same direction. The extensions are foldable such that the ends with the apertures are stacked and the string passes through the apertures in a line. Accordingly, the decoration forms a curved surface. Two edges of the main body can be attached to form a closed loop structure. The extensions may extend from both ends of the base portion to form fully enclosed surfaces, for example a sphere.

18 Claims, 11 Drawing Sheets

FIG. 5A
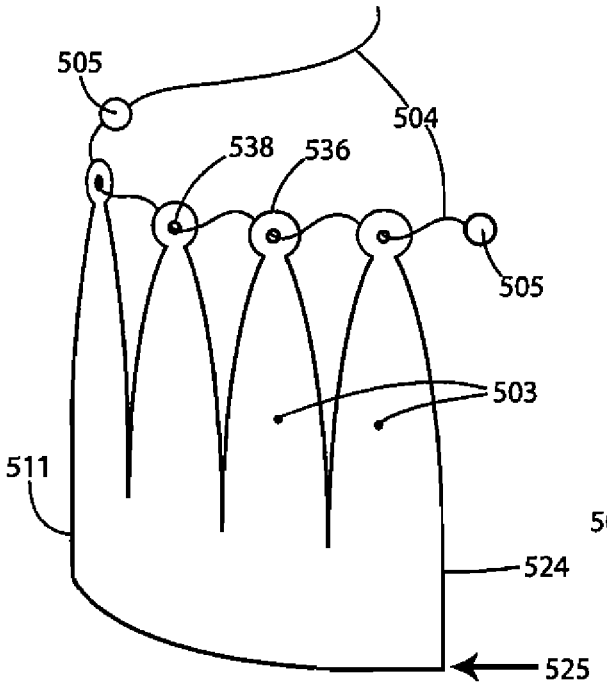
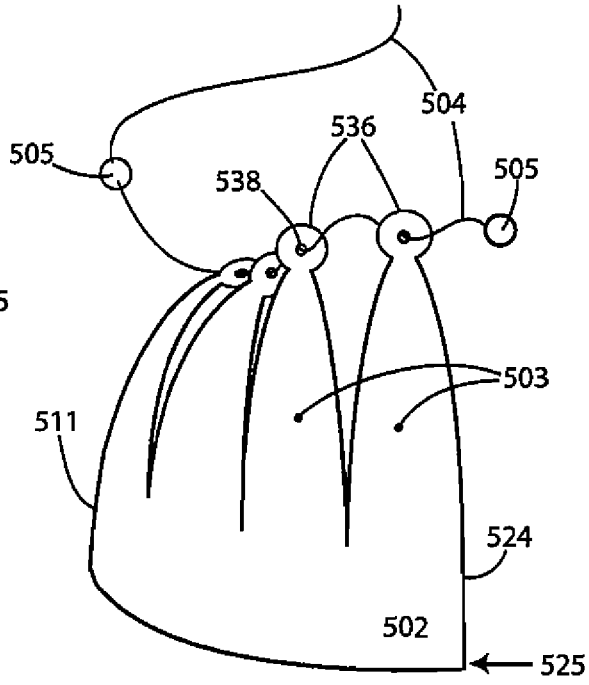
FIG. 5B
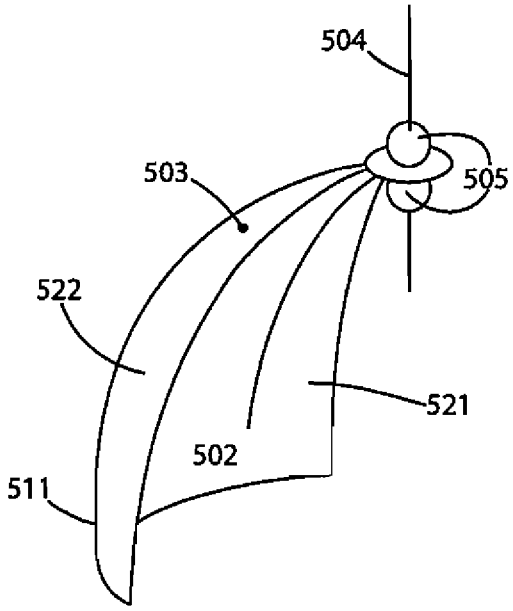
FIG. 5C

FIG. 8B
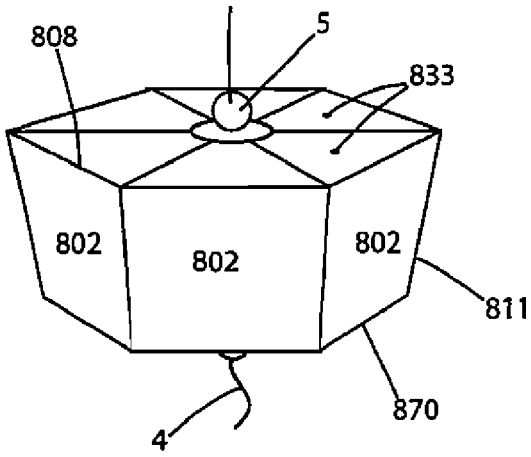
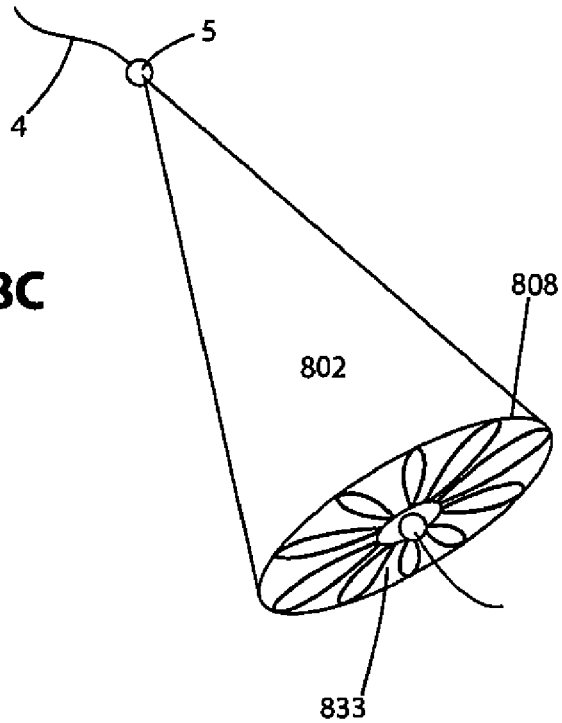
FIG. 8C
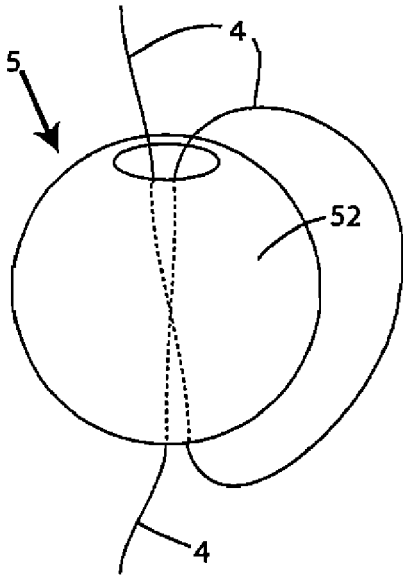
FIG. 9A

FOLDABLE PARTY DECORATION

FIELD OF THE INVENTION

The present invention is directed toward a party decoration, and is specifically directed to a party decoration that folds from a flat shape into a curved shape.

BACKGROUND

Decorations help provide fun and a festive environment for parties of all types. Streamers, balloons and colorful banners arranged around a room are a clear indicator that it's time to celebrate. The festivity inspired by these classic decorations can be further enhanced by the addition of more unique ornaments. An exceptionally attractive or innovative decoration can capture the attention of guests at the party and become a conversation piece, further promoting the casual environment.

However, problems are presented when the decorations are three dimensional. Such decorations are large and/or bulky and take up and inordinate amount of store display space. Additionally, they are difficult to carry by hand and even more difficult to transport.

It is therefore an object of the present invention to provide a unique party decoration that is packaged as a flat member and is foldable into a curved shape, for example, a sphere.

SUMMARY OF THE INVENTION

The present invention is for a party decoration that is foldable from a flat convenient shape for packaging, display and/or transportation into an attractive curved form.

An exemplary embodiment of the invention folds from a flat, planar body into a sphere. More specifically, a flat main body is formed with an elongate base and two sets of extensions extending outwardly therefrom. The base also has two opposing edges. In its final construction the base is bent over and the edges attached to one another forming a closed loop structure. Both sets of extensions project in directions that are parallel, each having an identical shape that includes centerlines perpendicular to the elongate direction of the base. Within each set, all of the extensions have curved side edges in a direction away from the base (much like the peel of an orange wedge). Each extension has a defined end portion at its free end with an aperture therethrough. A string extends through each aperture in one set of extensions, passing sequentially from a first side of the flat body to a second side. The second set of extensions also includes a string passing through each aperture in a similar manner.

To form the sphere, the closed loop base section is held open forming a cylinder. One set of extensions are then bent inward with each end portion sliding along the string until all of the end portions are stacked and the string passes in a line through the apertures of the entire set. Thus, the set of bent extensions forms half of a sphere. The extensions are held in place either by friction or by a holding element disposed on the string on either side of the stack. To complete the sphere, the same step is carried out on the second set of extensions.

The decoration is not required to be a sphere in order to fall within the scope of the invention. For example, two sets of extensions are not required. A hemisphere may be formed with a single set of extensions. Similarly, the extensions may extend from one side of triangle, such that a cone with a circular end can be formed. Further, it is not required that the base be a loop such that its edges are adjacent. A wide variety of concave shapes can be formed from originally flat members in accordance with the invention. By changing the relative sizes of the branches, oblong and non-circular shapes can be created.

BRIEF DESCRIPTION OF THE FIGURES

These and other objects and features of the invention will become more apparent by referring to the drawings, in which:

FIG. 5*a* is a front elevational view of an embodiment of the invention in a flat position;

FIG. 5*b* is a perspective view of the embodiment of FIG. 5*a* in a partially folded condition;

FIG. 5*c* is a perspective view of the embodiment of FIG. 5*a* folded into a curved shape;

FIG. 8*b* is a perspective view of the embodiment of FIG. 8*a* folded with a three-dimensional shape;

FIG. 8*c* is a perspective view of another embodiment folded into a three-dimensional shape;

FIG. 9*a* is a perspective view of one embodiment of a string holding element.

DETAILED DESCRIPTION OF THE PREFERRED EMBODIMENTS

Figure 1A:
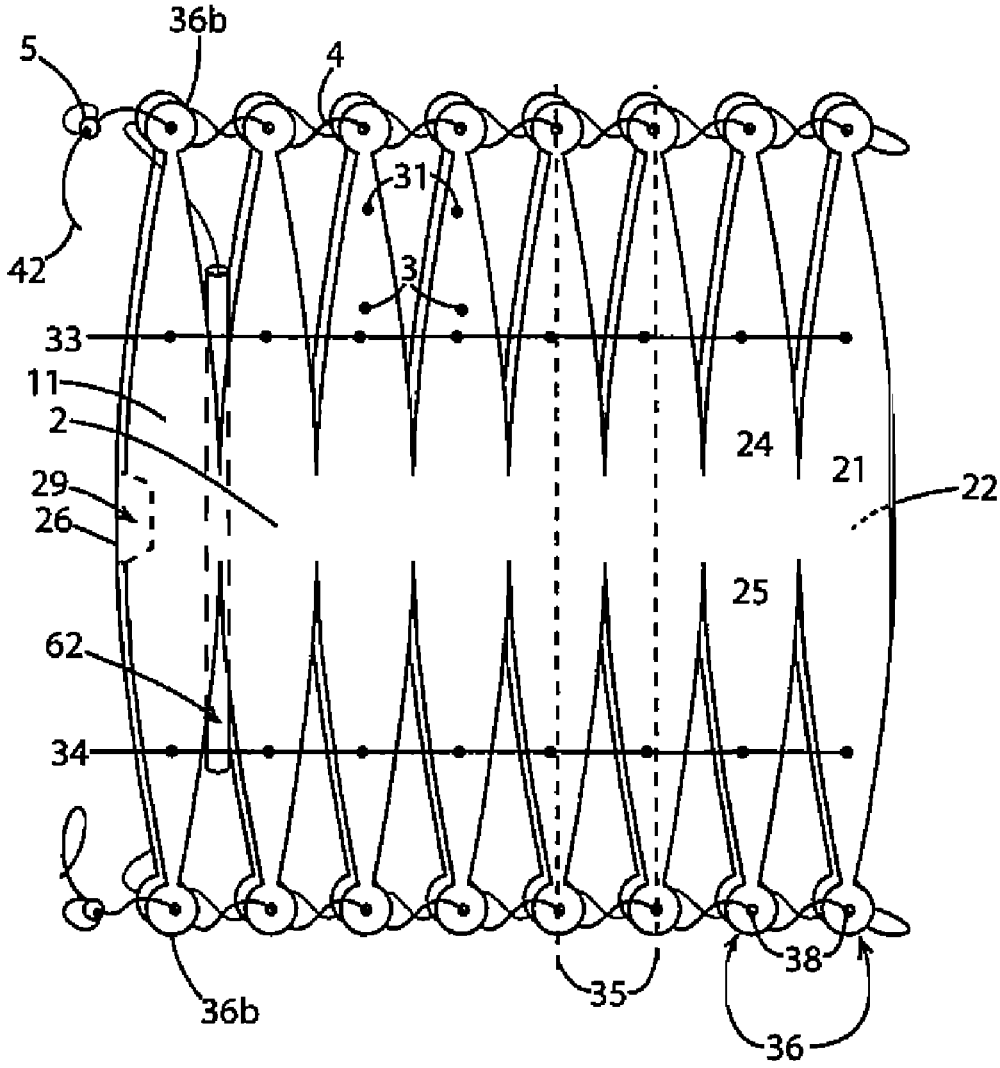
FIG. 1*a* is a front elevational view, of an embodiment of the invention in a flat condition.

FIG. 1*a* shows an exemplary embodiment of the foldable party decoration of the present invention in its flat state. The invention has multiple uses, as discussed below, but for simplicity it will be referred to as a decoration. The decoration 1 includes a substantially planar main body 11 with a front or first section 21 superimposed on a rear or second section 22 (shown in FIG. 1*b*). The flat main body 11 includes an elongate central base 2 and two sets 33, 34 of extensions extending in opposite directions from elongate sides of the base 2. The first set 33 extends outwardly from a top 24 of the base 2 while the second set 34 extends outwardly from the bottom 25 of the base 2. The extensions are parallel to each other along respective centerlines 35 and the side edges of each extension curve towards each other. Provided at the free end 39 of each extension 33, 34 is a circular end portion 36 which includes a centrally located aperture 38 therethrough. The end portions 36 may be larger than the adjacent portion of the extension. The base 2 also has respective free edges 26 at the ends of the end sections 21, 22. As shown in FIG. 1*a*, the main body 11 is folded such that the edges 26 are adjacent one another to form an endless loop structure. A tab 29 on section 22 is used to attach one edge 26 to the other. In a preferred embodiment the tab 29 is attached to the section 21 using an adhesive or any other fastening device, such as a staple.

The main body 11 may be formed as a sheet-like structure, from any of a variety of materials including paper, paper board, plastic sheet, metallized card stock, metallized or clear plastic sheet, or similar materials. Generally, the main body 11 may be formed of any sheet-like material that is flexible but has some degree of ability to retain shape. Specific embodiments have been made with 150-300 gram card board both with and without a foil layer. PVC sheets have also been used for the main body 11 ranging in thicknesses from 0.1-0.35 mm, both clear and metallized, such as Mylar®. The overall size of the main body may also vary. Specific embodiments have been made ranging in size from a few inches to two feet in diameter.

Figure 1B:
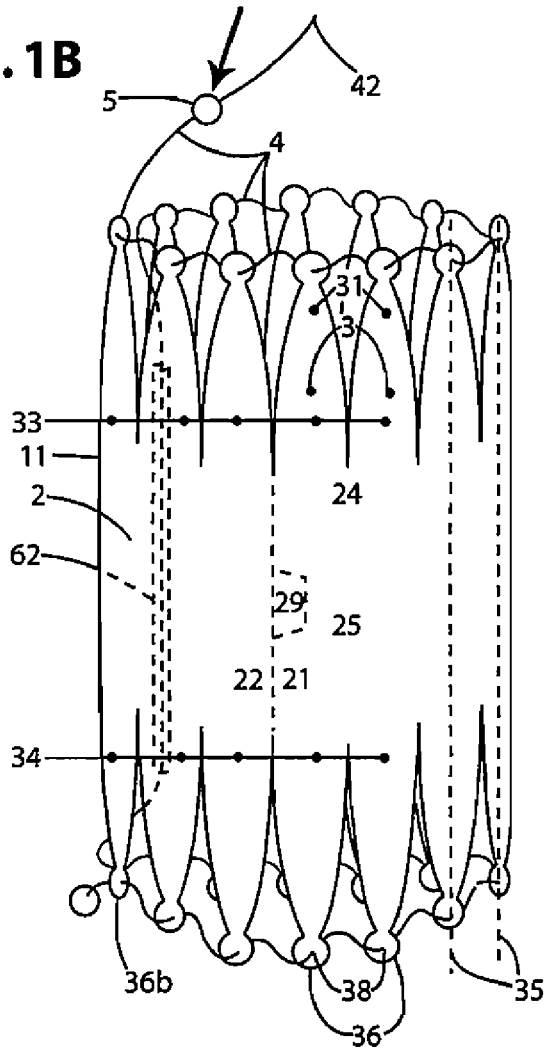
FIG. 1*b* is a perspective view of the embodiment of FIG. 1*a* during a folding process.

The decoration of FIG. 1*a* also includes a string 4 that passes through the apertures 38 of all of the extensions. As shown in FIG. 1*b*, string 4 extends through end portion 36*b* in end section 22, and through the remaining apertures in set 33 including the aperture in portion 36*a* of set 33. The string also extends through a central passage in a tube or straw 62 positioned between the sections, through portion 36*a* of set 34, through the remaining the apertures in portions 36 of set 34, and through the aperture in portion 36*b* of set 34 (not show in FIG. 1*b*). Holding elements 5 is provided on the loose ends 42 of the string. The string 4 is not particularly limited and can be formed in any manner that would encompass the broad definition of the words string, cord or wire. Specific embodiments include thread and plastic cord. Particular success has been obtained using polymer lines, similar to fishing line. All of the illustrated embodiments shown throughout the Figures show the string 4 passing through the extensions consecutively, with the string 4 passing through the aperture 38 of one extension and then passing through the aperture 38 of an adjacent extension from the outside surface of one extension to the inside surface of the next adjacent extension. It is emphasized that the string 4 must go through each hole the same way either all back to front or front to back.

Figure 1C:
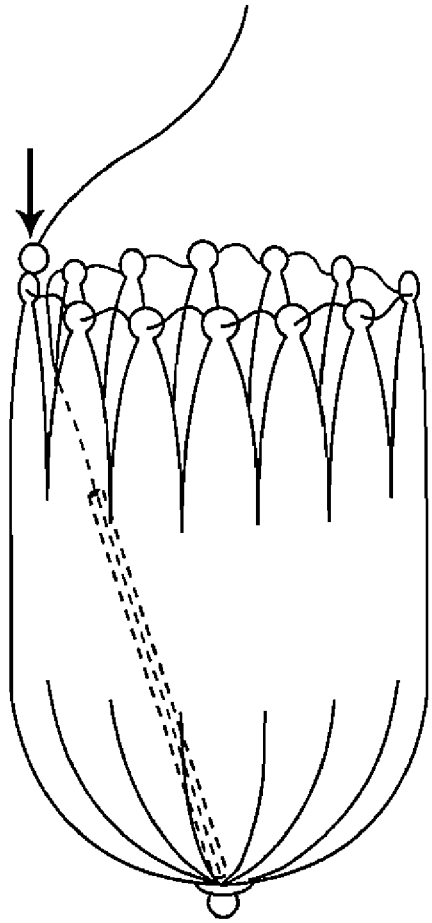
FIG. 1*c* is a perspective view of the embodiment of FIG. 1*a* partially folded into a spherical shape.
Figure 1D:
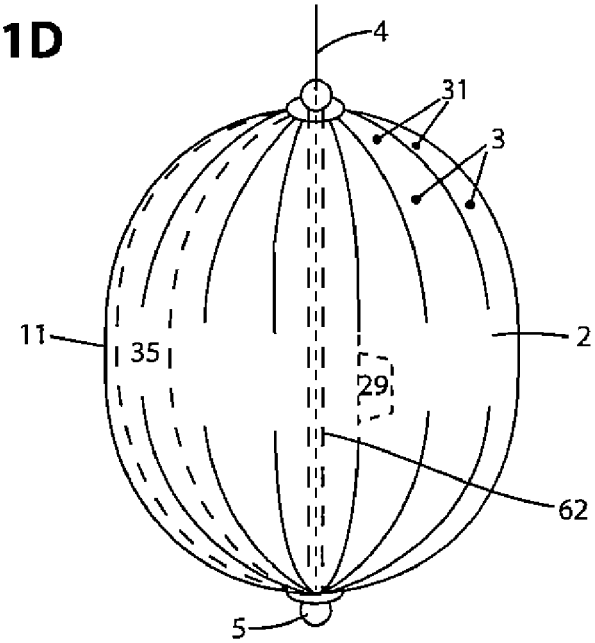
FIG. 1*d* is a perspective view of the embodiment of FIG. 1*a* folded into a spherical shape.

To form the decoration 1 into a sphere as shown in FIG. 1*d*, the flat main body 11 is opened into a cylindrical shape, as shown in FIG. 1*b*. The loose ends 42 of the string 4 are then pulled in opposite directions away from the main body 11. As a result, the force exerted by the string 4 forces the extensions 3 to fold over toward the center of the cylinder formed in FIG. 1*c*. Consequently, the end portions 36 begin to stack, one atop another, along the axis of the cylinder. That is, for each set of extensions 33, 34 the inner end portion 36*a*, which is furthest from the loose end 42 of string element 4, folds to the bottom of the stack until it abuts the end of the tube 62. Accordingly, the inner end portions 36*a* are spaced apart from each other by the length of tube 62. Thus, tube 62 serves as a gap holder ensuring that the extensions are not folded over too far, to the point that the decoration 1 is flattened or becomes an oblate spheroid. In other words, the tube 62 limits further inward travel of the extensions and its length determine the height of the sphere.

That is, the tube 62 is approximately the length of the diameter of the sphere. In terms of the main body 11, the length of the tube is approximately $2/\pi$ multiplied by the length from the aperture 38 on one extension in set 33 to the aperture 38 on an opposite extension in set 34. More specifically, the tube 62 has a length between 0.6 and 0.7 times the length between opposite apertures 38.

If the act of pulling on the loose ends 42 of string 4 alone does not tightly stack the end portions 36, the outer end portions 36*b* can be forced toward tube 62. Once all of the branches are folded over and the end portions 36 of each set 33, 34 are tightly stacked on either side of the tube 62, the spherical decoration shown in FIG. 1*d* is formed.

Depending on the materials used for the string 4 and main body 11, the decoration may remain in the spherical form by frictional forces alone, or the user can tie a knot in the string 4 next to the outermost apertures 38 to prevent the outermost extension 3 from moving away from tube 62 along the string 4. Alternatively, one or more holding elements 5 can be included on the loose ends 42 string. A holding element 5 moved into contact with the outside of the curved decoration 1 adjacent the outermost end portion 36*b* prevents the extensions from moving away from the tube 62.

Instead of having two moving holding elements 5, the decoration 1 may include a fixed holding element at one end 42 of the string 4 and a slidable holding element 5 at the other end. In this embodiment, the main body 11 of the decoration 1 is slid toward the fixed holding element and the slidable holding element 5 is used to retain the decoration into a compact sphere.

Figure 9B:
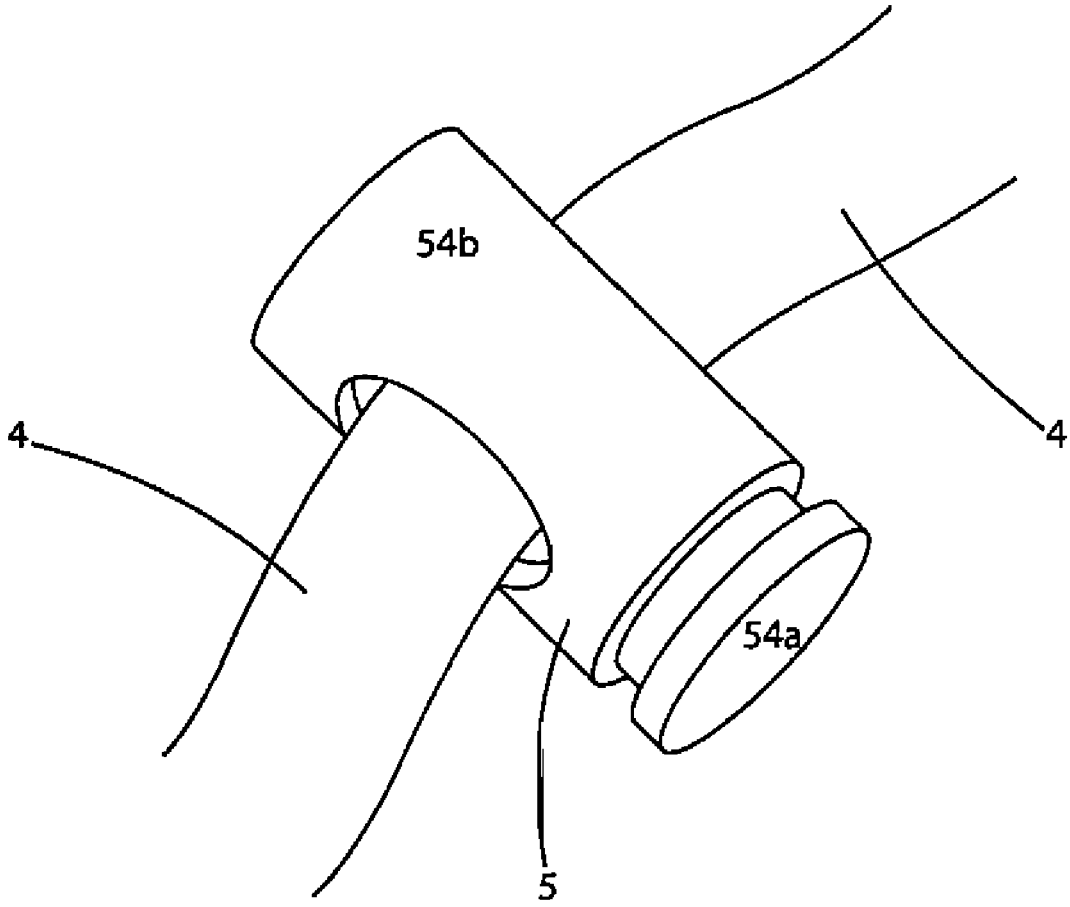
FIG. 9*b* is a perspective view of another embodiment of a string holding element.

Various structures can be used to serve as the slidable holding element 5. For example, the holding element 5 can comprise a simple hollow bead 52, as shown in FIG. 9*a* to an enlarged scale. Friction between the bead 52 and the string element 4 can generate enough force to hold the decoration in place. For additional holding power, the string 4 may be passed through the bead twice, as shown in FIG. 9*a*. As a result of this structure, the holding element 5 is held in place by added friction between the holding element 5 and the string 4. Another example of a holding element 5 is a conventional spring loaded cord lock 54, shown in FIG. 9*b*. A spring (not shown) champs the string between a depressable plunger 54*a* and the casing 54*b*. The cord lock 54 holds tightly on the string 4 and can effectively hold the decoration 1 in a curved position.

Figure 1E:
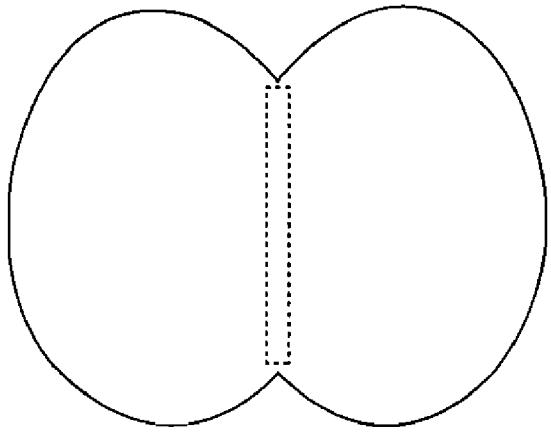
FIG. 1*e* is a perspective view similar to FIG. 1*d* illustrating the shape of the decoration of the invention with a short center tube.

The length of the tube 62 will also determine the shape of the decoration. Thus, for the length $2/\pi$, the shape is a sphere as shown in FIG. 1*d*. For a shorter length, the decoration may take the shape shown in FIG. 1*e*.

The foregoing description of a decoration is exemplary, and many of the features included therein are not required in the present invention. The embodiments shown in FIGS. 2-7 do not include all of the features shown in the above spherical embodiment. In the descriptions that follow, similar reference numerals are used as in the embodiment of FIGS. 1*a*-1*e* but preceded by the Figure designation.

Figure 2:
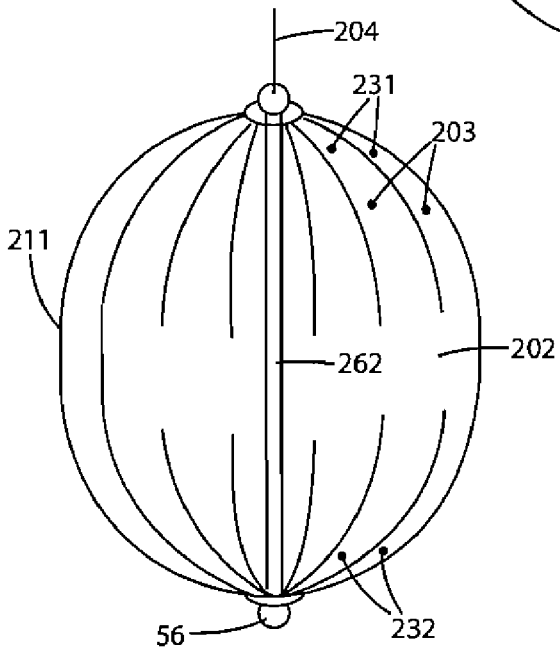
FIG. 2 is a perspective view of an embodiment of the invention in a curved or elliptical shape.

The decoration 200 shown in FIG. 2 does not have a closed loop base. In this embodiment the decoration 200 has two sets of extensions extending from the base 200 of the main body 211. First extensions 231 of a set extend outwardly from the top of the base, and second extensions 232 of the second set extend outwardly from the bottom of the base 200. A string element 204 passes through each set similarly to the embodiment show in FIGS. 1*a*-1*c*. A tube 262 can be used to separate the end portions of each set. Again, the gap holder on tube 262 ensures that the extensions are maintained apart by a set distance. In the embodiment shown, the string element 204 passes through a central passage of the tube.

The embodiment shown in FIG. 2 include a fixed holding element 205 at one end (i.e., the bottom end) of the string element 204, a tube 262 and a slidable holding element 205. To transform the decoration from its flat position to its curved position a user holds the free end of the string element 204 and slides the slideable holding element 205 toward the tube 262. Consequently, the extensions will fold over toward the center until stacks of end portions are formed adjacent each end of the tube 262 and the holding elements 205 maintain the decoration in the shape shown.

Two separate elements may be used in place of the tube 62 or the tube 262. For example, two fixed holding elements can be placed on the inside portion of the string element at a fixed distance from each other. Thus, the two fixed holding elements serve to limit inward movement of the extensions toward the center of the decoration. That is, the tube may be omitted. In this case, it may be desirable to have holding elements 205 on both sides of each set of extensions in order to hold the end portions 36 of the respective set in a tight stack.

Figure 3A:
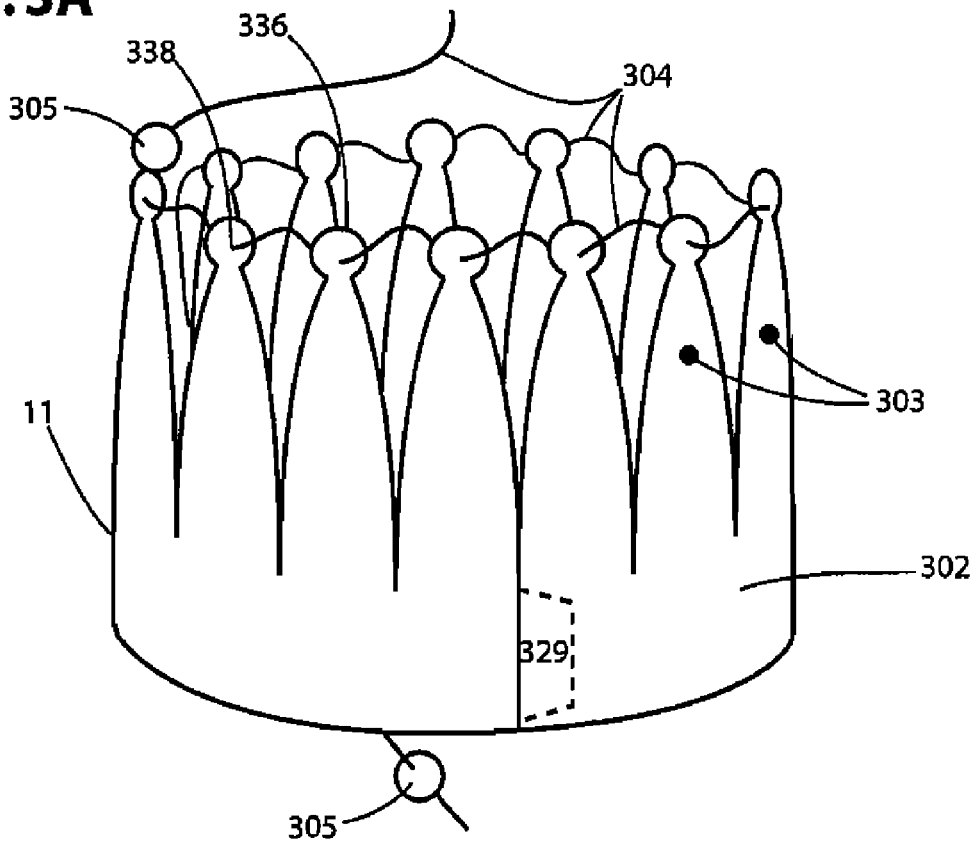
FIG. 3*a* is a perspective view of an embodiment of the invention with a single set of extensions, in a partially folded position.
Figure 3B:
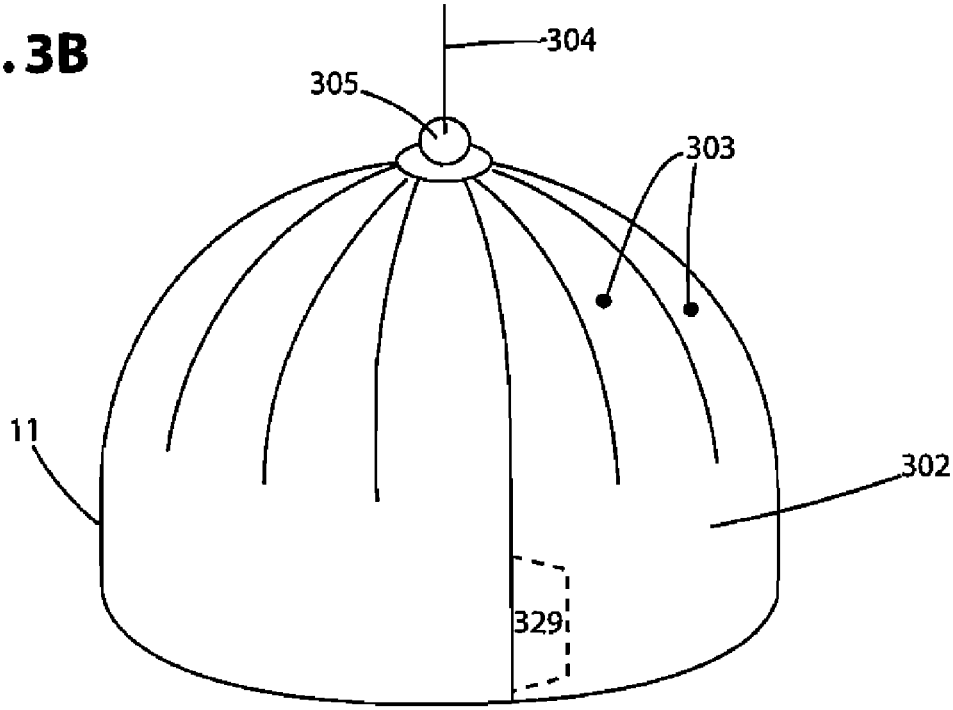
FIG. 3*b* is a perspective view of the embodiment of FIG. 3*a*, shown in a curved position.

Another embodiment of a decoration 301 is shown in FIGS. 3*a* and 3*b* and includes only one set 335 of extensions. However, the base 302 is formed into a cylinder and the outer edges are attached to one another forming a closed loop structure, similar to the spherical embodiment of FIGS. 1*a*-1*c*. In this embodiment, a tube is not necessary, but it may be advantageous to include a holding element 305 on either side of the extensions 303, as shown. When the extensions 303 of the looped base 302 are folded to form a curved decoration, such as that shown in FIG. 3*b*, the curved decoration 301 forms half of a closed rounded surface. For example, if the branches 303 are appropriately equally sized, the curved decoration will form a hemisphere.

Figure 4A:
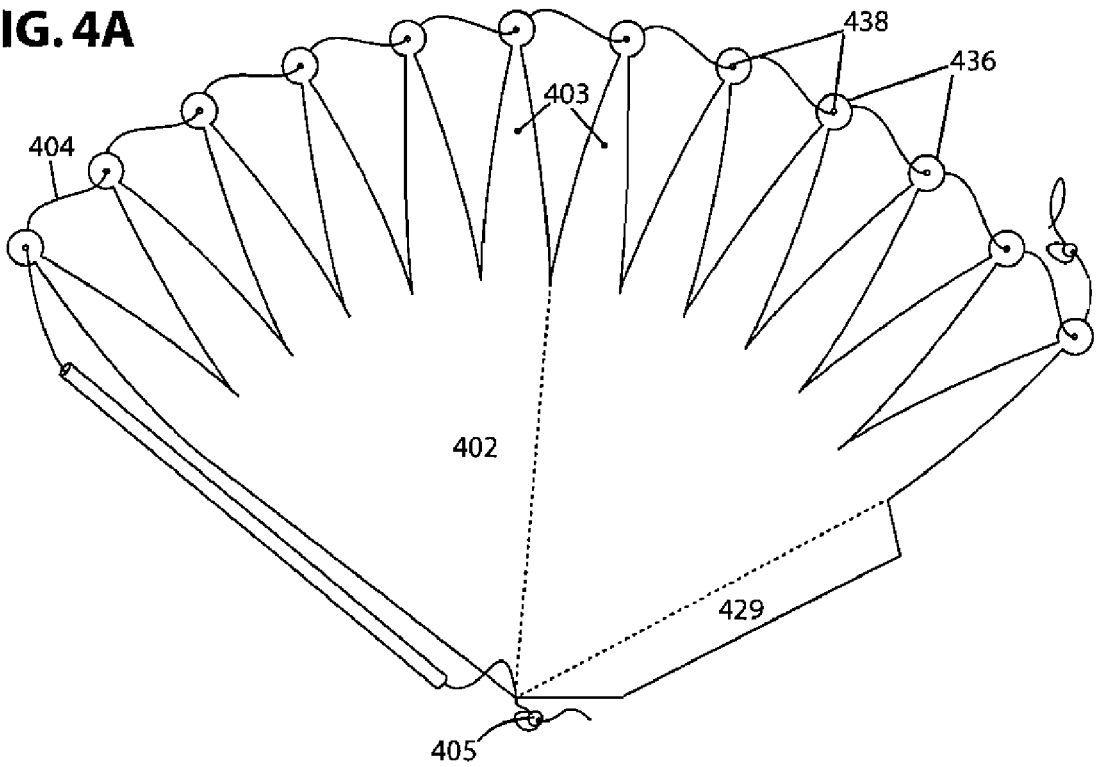
FIG. 4*a* is a front elevational view of an embodiment of the invention with a partial circular base and one set of extensions, in an open flat position.
Figure 4B:
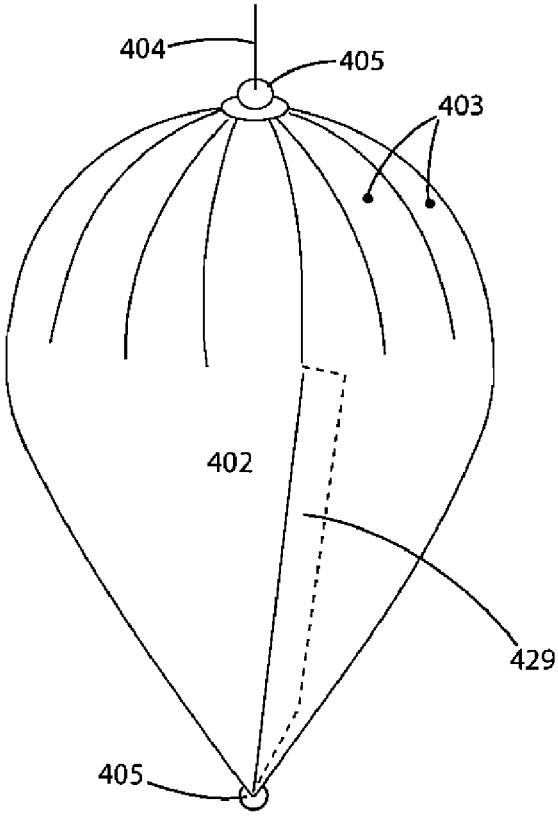
FIG. 4*b* is a perspective view of the embodiment of FIG. 4*a* folded into a conical shape.
Figure 4C:
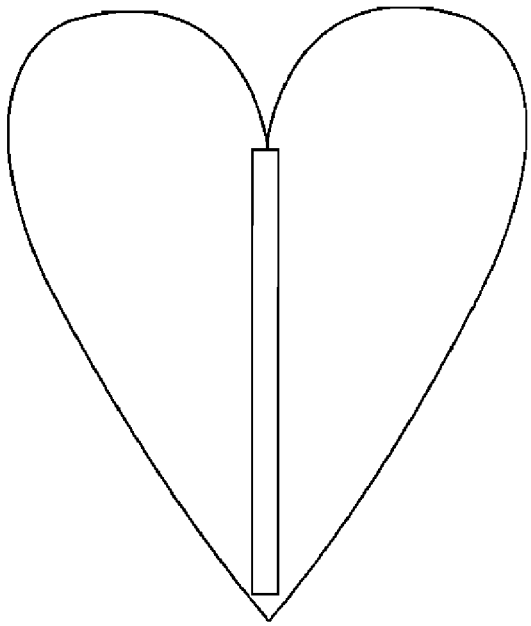
FIG. 4*c* is a perspective view similar to the embodiment of FIG. 4*b* folded into a heart shape.

Yet another embodiment of a decoration constructed according to the present invention is shown in FIGS. 4*a* and 4*b*. The base 402 is formed as a segment of a circle and the extensions 403 extend outwardly as shown in FIG. 4*a*. The base 402 of this particular embodiment forms a cone shape when tab 429 is attached to the base 402 adjacent the edge 454. When the extensions 403 are stacked together along string 404, the decoration 401 forms a three dimensional cone with a rounded top as shown in FIG. 4*b*. This shape can be colored to represent an ice cream cone or parachute.

Similarly to the spherical decoration, the shape of the decoration shown in FIG. 4*b* may be varied by making the length of the tube 62 shorter. Thus, with a shorter tube 62, the extensions 403 will curve inwardly at their respective ends to form the heart shape shown in FIG. 4*c*.

A simplified embodiment of the decoration of the present invention is shown in FIGS. 5*a* through 5*c*. This embodiment includes only one set of extensions 503 extending outwardly from a top 524 of the base 502. The base 502 is not formed into an endless loop construction as it is in the embodiments shown in FIGS. 1*a*-*c*, 3*a*-*b* and 4*a*-*b*. The embodiment shown in FIGS. 5*a*-5*c* includes a string 504, holding members 505, a base 502 and a set of extensions 503. As shown in the drawings, the extensions are folded over and the end portions 536 are stacked along string element 504 in the manner previously described to form the curved shape shown in FIG. 5*c*.

Figure 6A:
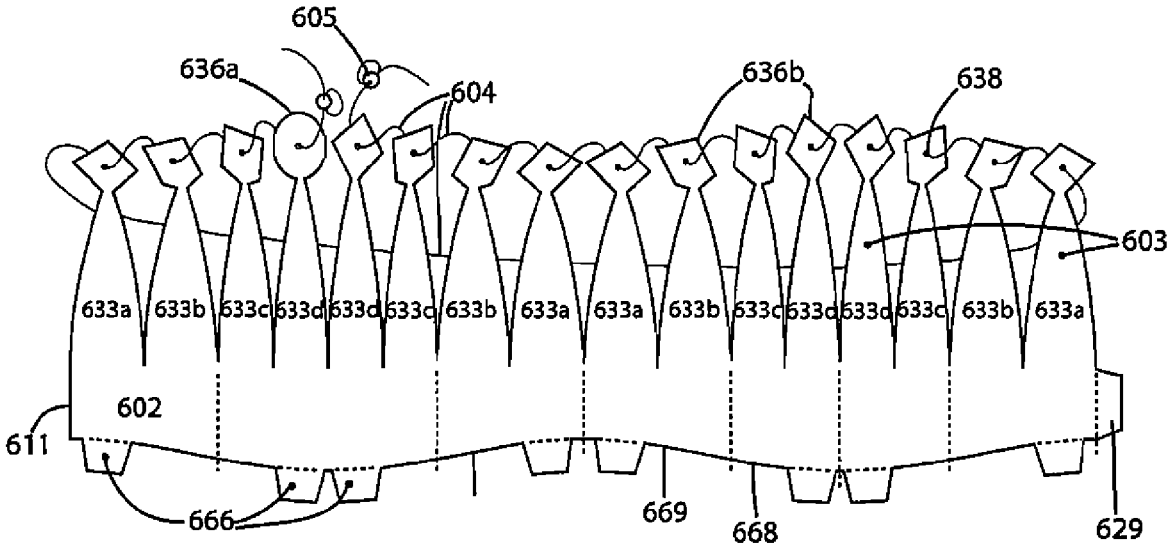
FIG. 6*a* is a front elevational view of an embodiment of the invention in a flat position showing extensions of differing lengths and widths.

The shape of the decoration in the folded state can be varied by changing the shape of the base and the length of the extensions. An embodiment with varying extension sizes in both length and width is shown in FIG. 6*a*. In this embodiment, the base is oval rather than circular. More specifically, as shown in FIG. 6*a*, the bottom edge 669 of the base 602 is formed as a vane with extending tabs 666. Each set of extensions 663*a*-663*d* repeat in descending order. That is each set 663*a*-663*d* is followed by the set 663*d*-663*a*. The height of each respective one of the extensions 663*a*-663*d* in each set increases while the width thereof decreases so extension 663*a* is the shortest whereas extension 663*d* is the widest.

Figure 6B:
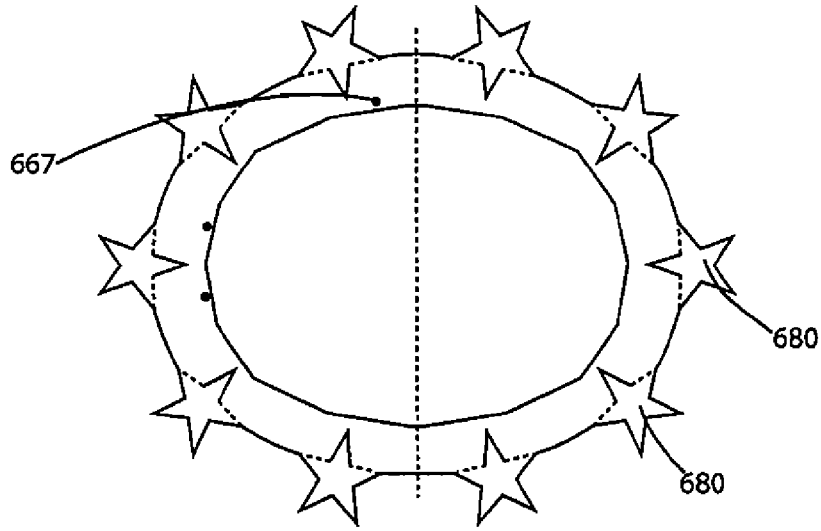
FIG. 6*b* is a top plan view of the embodiment of FIG. 6*a;*
Figure 6C:
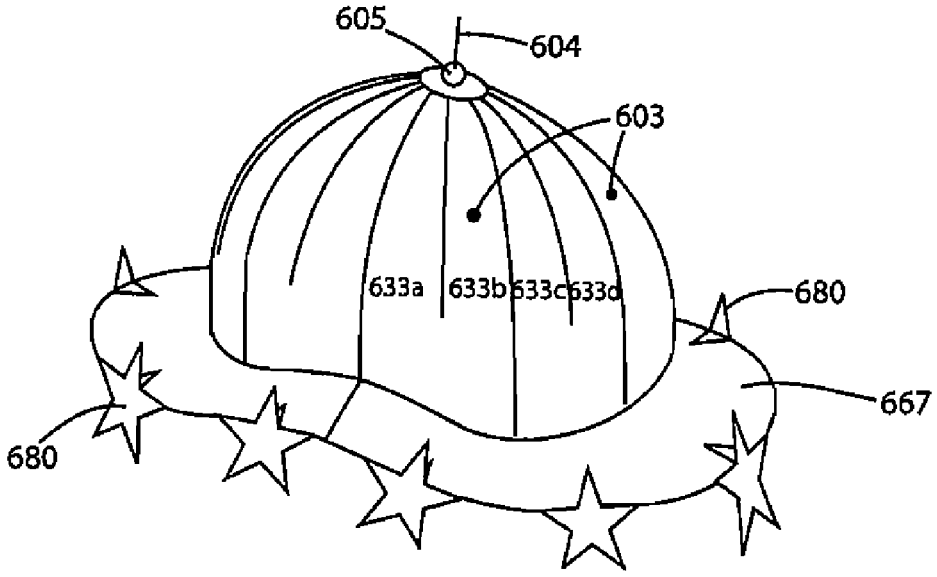
FIG. 6*c* is a perspective view of the embodiment of FIG. 6*a* folded into a curved shape.
Figure 7A:
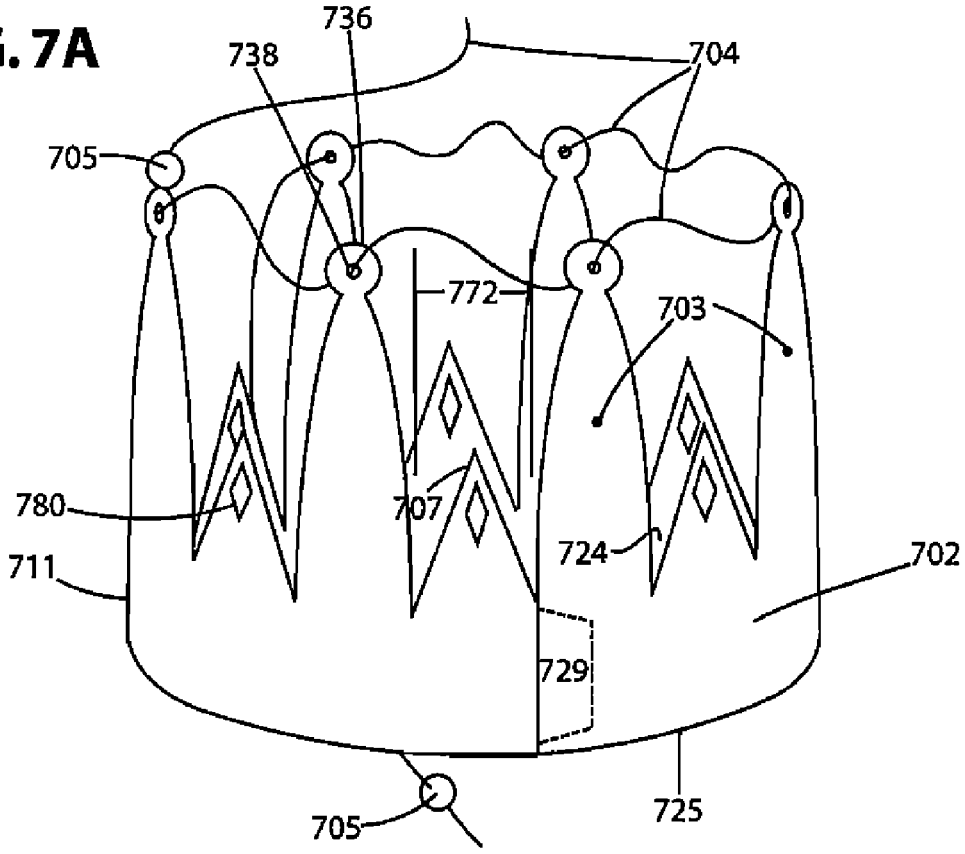
FIG. 7*a* is a front elevational view of an embodiment of the invention in a flat position showing gaps between the extensions.
Figure 7B:
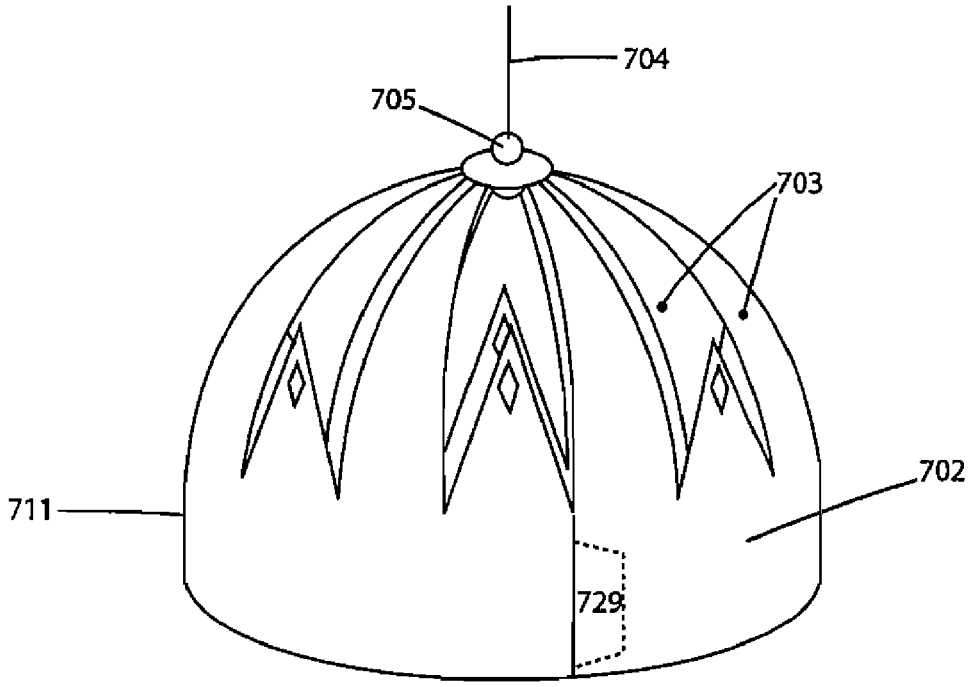
FIG. 7*b* is a perspective view of the embodiment of FIG. 7*a* in folded condition.

As the ends of the string 604 are pulled, the elements 636*b* fold under the element 636*a* forming the oval shape shown in FIG. 6*b*. A brim 667 having a cut-out in the shape of the bottom of the formed oval receives the same therein and is connected thereto by the tabs 666 by adhesive or any other fastening means. The brim may be provided with stars 680 about its periphery to form a festive derby.

The central longer extension 603 will form a deeper curve than the outer shorter extensions when the decoration is folded into the curved position. In the illustrated embodiment, the base 602 is also curved to complement the lengths of the extensions 603.

The extensions formed in the main body are not required to be directly adjacent each other. For example, gaps may be provided between the extensions resulting in holes in the decoration when in the curved position. The embodiment shown in FIG. 7 includes gaps 772 shown between each pair of adjacent extensions 703. Other features may also be added between the branches 703 to form more unique shapes of the decoration 701. For example, the embodiment shown in FIG. 7 includes short extensions 707 of less length than the extensions 703 and positioned between each of the layer extensions. The illustrated extensions extend upwardly from the base portion 702 of the main body 711 and include apertures 780 therethrough. However, the string 704 does not pass through the apertures in the shorter extensions.

Figure 8A:
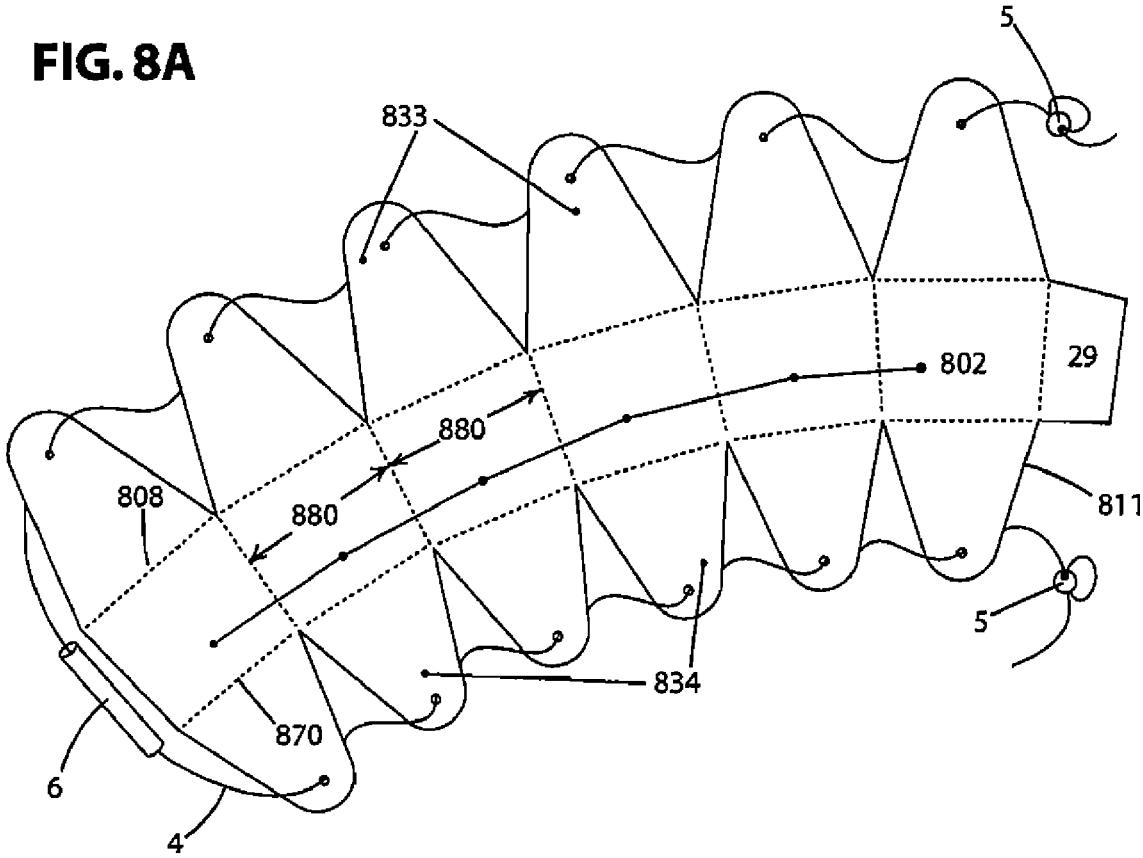
FIG. 8*a* is a perspective view of an embodiment of the invention showing extensions of differing widths.

An alternative embodiment is shown in FIG. 8*a* wherein horizontal fold lines 808 are provided at the junction of extensions 803 of the top set 833 and the base portion 802. Similarly, fold lines 870 are provided between the extensions 803 of the bottom set 834 and base portion.

Further, the base portion may include vertical fold lines 880 between each extension 803. The fold lines permit the completed decoration shown in FIG. 8*b* to form a geometric shape. In the illustrated embodiment, the width of each extension 803 at fold lines 808 is slightly wider than the width at fold lines 870. The difference in width causes a slight arc in the main body 811 when viewed in elevation in the flat state, as shown in FIG. 8*a*. When the decoration is folded along fold lines 808 and 870 and string 804 tightened, the device will assume the three dimensional shape shown in FIG. 8*b*, with the top edge of each side panel being slightly larger than the bottom edge due to the difference in width. Accordingly, the decoration 811 tapers inwardly from the top to the bottom when in the folded position. Alternatively, the tapered shape of the decoration is not required. This can be accomplished by making the widths even at the fold lines 870 and 808. A large variety of shapes is possible within this embodiment. For example, the decoration may include two sets 833, 834 of four extensions to form a cube, or two sets 833, 834 of eight extensions to form an extruded octagon. Thus, FIG. 5*c* combines the cone of FIGS. 4*a*-4*b* with the geometric shape of FIG. 5*b*. In FIG. 8*c*, the extensions 403 have been replaced with the extension 833.

Although the invention has been described in the context of a party decoration, it has a multiplicity of possible uses. These uses include: a hat, a container, lampshade, a toy and many other possibilities. Further, though the preferred forms of the invention have been shown and described, many features may be varied, as will readily be apparent to those skilled in this art. It is the intention, therefore, to be limited only as indicated by the scope of the claims appended hereto.

I claim:

1. A decoration comprising:

a substantially flat main body having a first side and a second side and including:

an elongate base portion with a top, a bottom and two side edges, the base portion forming a closed loop structure with the side edges attached to one another, two sets of extensions respectively extending upwardly from the top and downwardly from the bottom, of said base portions, the extensions of each set being substantially parallel, and an end portion at a free end of each extension having an aperture therethrough; and a string passing through each of the apertures of one set of extensions in a first direction, the first direction being from the first side to the second side, and passing through each of the apertures of the other set of extensions in a second direction, the second direction being from the second side to the first side, whereby the end portions in each set of extensions are stackable such that the string passes through the apertures of each set in a line and the decoration forms a closed surface.

2. The decoration of claim 1, further comprising two holding elements disposed on the string on opposite sides of the main body.

3. The decoration of claim 1, further comprising a gap holder disposed on the string between the sets of extensions.

4. The decoration of claim 2, further comprising a gap holder disposed on the string between the sets of extensions.

5. The decoration of claim 1, wherein the side edges of each extension curve toward each other in a direction away from said base portion.

6. The decoration of claim 1, wherein the end portions are enlarged compared to an adjacent portion of the respective extension.

7. The decoration of claim 1 wherein the main body includes a tab at one edge of the base portion, the tab being connected to the other edge to form the closed loop structure.

8. A decoration comprising:

a substantially flat main body having a first side and a second side and including:

a base portion with a top and a bottom, a plurality of first extensions extending from the top of the base portion in a first direction, and a first end portion at a free end of each first extension opposite the base portion, each first end portion including an aperture therethrough; and a string passing through each of the apertures from the first side to the second side, whereby the first end portions are stackable such that the string passes through the plurality of apertures in a line and the first end portions form a closed surface.

9. The decoration of claim 8, wherein the base portion further includes two edges, means attaching the edges to each other to form a closed loop structure of the base portion.

10. The decoration of claim 8, wherein the main body further comprises:

a plurality of second extensions extending from the bottom of the base portion in a second direction opposite the first direction;

a second end portion at a free end of each second extension opposite the base portion, each second end portion including an aperture therethrough; and wherein the decoration further comprises a second string passing through each aperture of the second end portions, whereby the second end portions are stackable such that the second string passes through the apertures of the second end portions in a line.

11. The decoration of claim 9, wherein the main body further comprises:

a plurality of second extensions extending from the bottom of the base portion in a second direction opposite the first direction;

a second end portion at a free end of each second extension opposite the base portion, each second end portion including an aperture therethrough; and wherein the decoration further comprises a second string passing through each aperture of the second end portions, whereby the second end portions are stackable such that the string passes through the apertures of the second end portions in a line and the decoration forms a substantially closed surface.

12. The decoration of claim 9, further comprising two holding elements disposed on the string on opposite sides of the main body.

13. The decoration of claim 10, wherein the first and second string are integrally formed.

14. The decoration of claim 13, further comprising two holding elements each disposed on one of the string, the two holding elements being on opposite sides of the main body.

15. The decoration of claim 14, further comprising a gap holder disposed on at least one of the first and second string between the first and second extensions.

16. The decoration of claim 8, wherein at least one of said first extensions has a length different from another of the plurality of first extensions.

17. The decoration of claim 8, wherein at least one of said first extensions has a width different from another of the plurality of first extensions.

18. The decoration of claim 8, wherein the base portion includes a plurality of tabs extending therefrom.

* * * * *